US008567351B2

(12) United States Patent
Cho

(10) Patent No.: US 8,567,351 B2
(45) Date of Patent: Oct. 29, 2013

(54) STEAM GENERATOR AND LAUNDRY MACHINE WITH THE SAME

(75) Inventor: Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 991 days.

(21) Appl. No.: 11/667,994

(22) PCT Filed: May 24, 2006

(86) PCT No.: PCT/KR2006/001949

§ 371 (c)(1),
(2), (4) Date: Mar. 7, 2008

(87) PCT Pub. No.: WO2007/026990

PCT Pub. Date: Mar. 8, 2007

(65) Prior Publication Data

US 2008/0302313 A1 Dec. 11, 2008

(30) Foreign Application Priority Data

Sep. 1, 2005 (KR) ..... 10-2005-0081234

(51) Int. Cl.
*D06F 33/00* (2006.01)
*D06F 39/08* (2006.01)

(52) U.S. Cl.
USPC ..... 122/19.1; 68/12.21

(58) Field of Classification Search
USPC ..... 122/19.1; 8/159; 68/12.21
See application file for complete search history.

(56) References Cited

U.S. PATENT DOCUMENTS

| | | | | |
|---|---|---|---|---|
| 5,602,958 | A * | 2/1997 | Vergnes | 392/395 |
| 6,577,815 | B1 * | 6/2003 | Wu | 392/402 |
| 7,621,155 | B2 * | 11/2009 | Ahn | 68/15 |
| 7,757,520 | B2 * | 7/2010 | Kim et al. | 68/15 |
| 7,987,616 | B2 * | 8/2011 | Bae et al. | 34/601 |
| 2004/0187529 | A1 * | 9/2004 | Kim et al. | 68/207 |
| 2005/0034487 | A1 * | 2/2005 | Oh et al. | 68/5 C |
| 2006/0191078 | A1 * | 8/2006 | Kim et al. | 8/159 |
| 2007/0199353 | A1 * | 8/2007 | Woo et al. | 68/5 R |
| 2007/0240458 | A1 * | 10/2007 | Kim et al. | 68/5 R |
| 2009/0277485 | A1 * | 11/2009 | Haltmayer et al. | 134/56 D |

FOREIGN PATENT DOCUMENTS

| | | | | |
|---|---|---|---|---|
| CN | 1534129 | | 10/2004 | |
| CN | 1580352 | | 2/2005 | |
| EP | 1464750 | A1 | 10/2004 | |
| EP | 1507029 | A2 | 2/2005 | |
| EP | 1 795 644 | | 6/2007 | |
| JP | 53-137287 | | 10/1978 | |
| JP | 2003-019382 | | 1/2003 | |
| KR | 10-2004-0085509 | | 10/2004 | |
| KR | 10-2005-0018182 | | 2/2005 | |
| KR | 1020050043000 | * | 5/2005 | D06F 33/02 |

* cited by examiner

*Primary Examiner* — Gregory A Wilson
(74) *Attorney, Agent, or Firm* — McKenna Long & Aldridge LLP

(57) ABSTRACT

A steam generator and a laundry machine equipped with the same are disclosed, the steam generator according to the present invention includes a case (100) for storing water for generating steam therein; an inlet (111) provided within the case (100) for drawing water there trough; an outlet (112) provided within the case (100) for discharging steam there trough; and a water-inlet-proof-partition-wall (800) for preventing the water drawn through the inlet (111) from being discharged through the outlet (112). An object of the present invention devised to solve the problem is to provide a steam generator which can prevent water from being discharged through an outlet (112) and supplied into a drum.

6 Claims, 2 Drawing Sheets

STEAM GENERATOR AND LAUNDRY MACHINE WITH THE SAME

This application claims priority to International application No. PCT/KR2006/001949 filed on May 24, 2006, and Korean Application No. 10-2005-0081234 filed on Sep. 1, 2005, all of which are incorporated by reference, as if fully set forth herein.

TECHNICAL FIELD

The present invention relates to a steam generator provided in an apparatus such as a laundry machine, and more particularly, to a steam generator which can prevent water supplied therein through an inlet from being drawn into an outlet thereof.

BACKGROUND ART

In generally, a steam generator is provided in a laundry machine such as a drum type washing machine with a drying function. The steam generator generates high temperature steam and supplies steam during a washing course, thereby, enhancing washing efficiency.

Recently, a dryer has been performing a refresh course in which steam is supplied to the laundry during a drying course to smooth out wrinkles and dry-clean the laundry. Thus, the steam generator may be applied to a dryer as well as a washing machine.

Accordingly, the steam generator may be used all kinds of laundry machines which wash or dry the laundry.

Referring attached drawings herewith, a conventional steam generator according to the related art will be described.

FIG. 1 is a perspective view illustrating a conventional steam generator according to the related art. FIG. 2 is a cut-away perspective view illustrating the conventional steam generator of FIG. 1 from another angle of view.

As shown in FIGS. 1 and 2, the steam generator according to the related art includes a case 1 having predetermined space therein to define an exterior thereof, and water for generating steam is stored in the predetermined space.

The case 1 includes an upper case 11 having an inlet 11*a* having a lower end thereof opened for drawing water and an outlet 11*b* for discharging steam there from, and a lower case 12 fastened to the lower portion of the upper case 11 with an upper end opened.

A heater 2 is provided within the case 1 to heat the water drawn into the case and to generate steam.

Here, a heater-fastening-hole 12*a* is formed in the lower case 12 of the case 1, and the heater 2 is mounted within the lower case 12 through the heater-fastening-hole 12*a*.

Also, sensors are provided on the case 1, which includes a temperature sensor 4 for sensing the temperature of the water drawn into the case 1 and a water level sensor 3 for sensing a water level.

Each sensing area is provided within the case 1, commonly fixedly secured through the upper case 11.

The inlet 11*a* of the upper case 11 is connected to a water supply valve (not shown) and a water supply pipe (not shown), and the outlet 11*b* is connected to a drum (not shown) and a steam pipe (not shown).

Thus, water for generating steam is drawn into the case through the water supply pipe and the inlet, and steam within the case is supplied into the drum through the outlet and the steam pipe.

However, the steam generator according to the related art may have a problem that some of the water supplied into the steam generator is drawn into the outlet 11*b*.

More specifically, since the inlet 11*a* and the outlet 11*b* are adjacent to each other with respect to a first side corner of the case 11, the water supplied through the inlet 11*a* splashes up to the outlet 11*b* to be drawn into the outlet 11*b*. Thereby, there may be a problem that low temperature water, not high temperature steam, is drawn into the drum and supplied as it is.

Thus, the effect of steam supply may deteriorate due to the water supplied instead of steam into the drum, or fabric may be damaged due to the high temperature water instead of steam.

Even in case that the inlet 11*a* and the outlet 11*b* are not adjacent to each other, potentially the above problems might be caused.

Also, in case water pressure supplied through the inlet 11*a* is high, the water supplied into the steam generator may raise spray. Hence, the created spray is directly drawn into the outlet 11*b* and supplied into the drum, thereby deteriorating efficiency of the steam generator.

DISCLOSURE OF INVENTION

Technical Problem

An object of the present invention devised to solve the problem is to provide a steam generator which can prevent water from being discharged through an outlet and supplied into a drum.

Technical Solution

To achieve these objects and other advantages and in accordance with the purpose of the invention, as embodied and broadly described herein, a steam generator includes: a case for storing water for generating steam therein; an inlet provided within the case for drawing water there through; an outlet provided within the case for discharging steam there through; and a water-inlet-proof-partition-wall for preventing the water drawn through the inlet from being discharged through the outlet.

Preferably, the water-inlet-proof-partition-wall is provided between the inlet and the outlet.

An inlet direction of the water drawn through the inlet may be perpendicular to an outlet direction of the steam discharged through the outlet, and the water-inlet-proof-partition-wall is expanded in parallel with the inlet direction of the water drawn into the inlet.

Preferably, the water-inlet-proof-partition-wall is formed in a plate shape expanded from a wall of a side of the inlet, having the inlet formed thereon, in parallel with a wall having the outlet formed thereon. Also preferably, an end of the water-inlet-proof-partition-wall is expanded to the outlet.

Meanwhile, the case includes: an upper case having a lower end thereof opened; and a lower case fastened to the upper case, the lower case having an upper end thereof opened.

Preferably, the inlet and the outlet are provided in the upper case and the water-inlet-proof-partition-wall is provided between the inlet and the outlet.

The water-inlet-proof-partition-wall may be provided within the upper case.

For accomplish the object, the present invention presents a laundry machine includes: a drum for holding the laundry therein; a steam generator for heating water and generating steam; a water supply pipe for supplying water for generating steam into the steam generator; and a steam pipe for supplying the steam generated in the steam generator into the drum.

Advantageous Effects

A steam generator according to the present invention has an advantageous effect that water supplied though an inlet may be prevented from being drawn through an outlet.

Furthermore, the steam generator according to the present invention has another advantageous effect that water splash may be prevented from being drawn through the outlet, even though water in the air causes splash due to a high pressure of the water supplied through the inlet.

Therefore, the steam generator according to the present invention has the advantageous effect of preventing problems which night arise in supplying water, not steam to the laundry within the drum because the steam generator according to the present invention can prevent water, not steam from being supplied in the drum.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
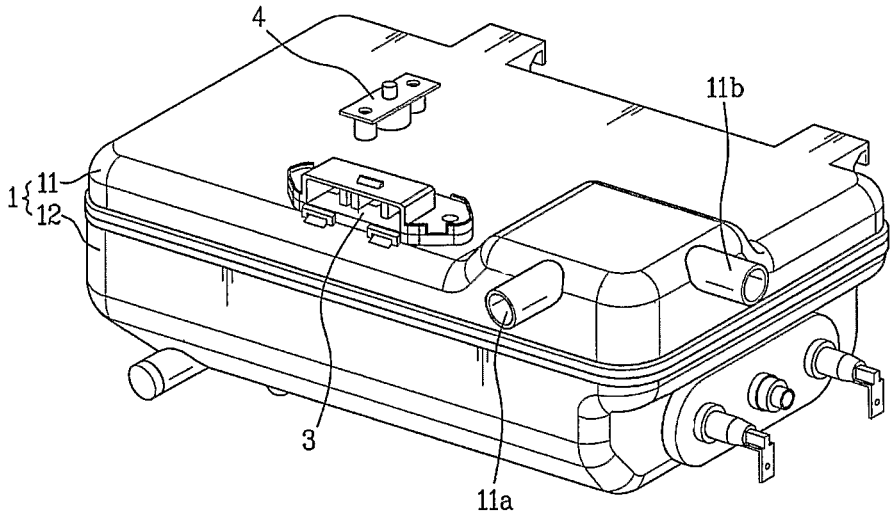
FIG. 1 is a perspective view illustrating a conventional steam generator according to the related art.
Figure 2:
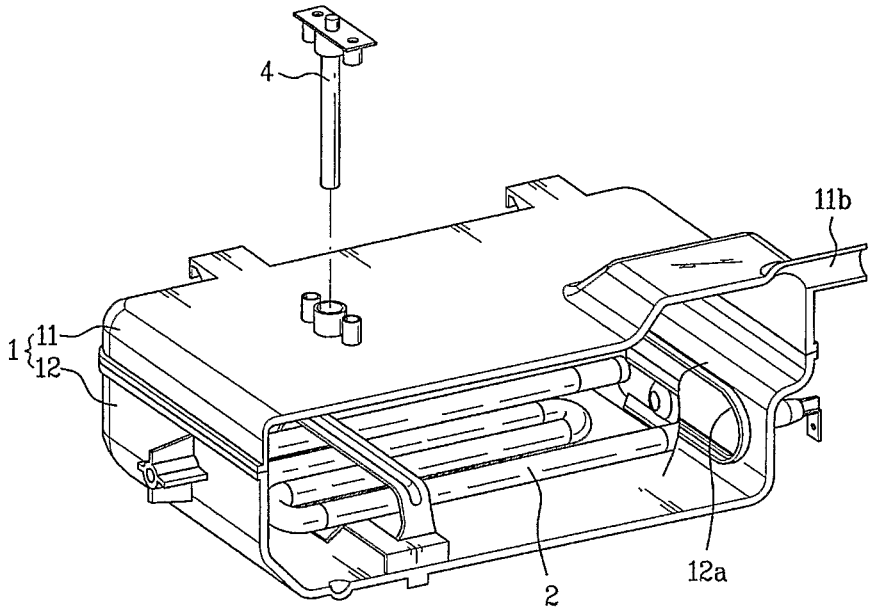
FIG. 2 is a cut-away perspective view illustrating the conventional steam generator of FIG. 1 from another angle of view.
Figure 3:
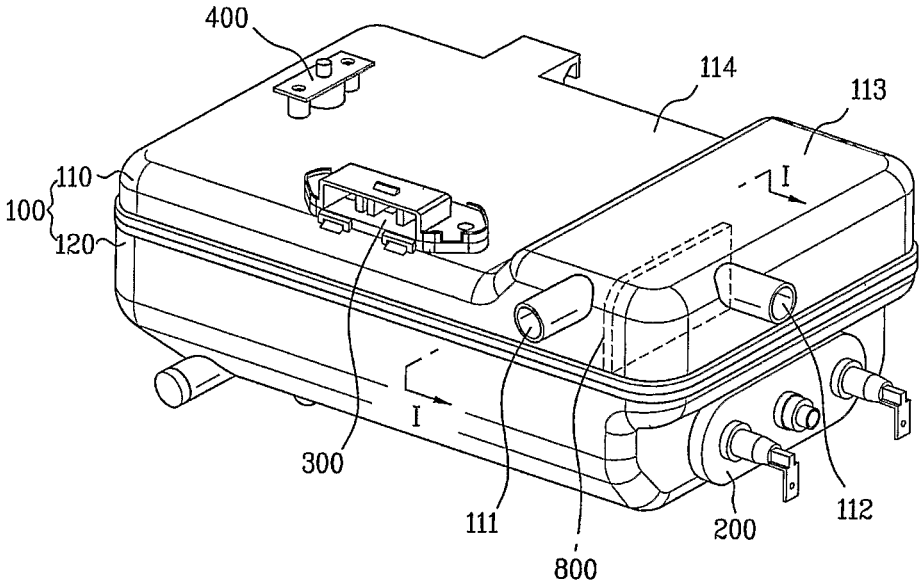
FIG. 3 is a perspective view illustrating an embodiment of a steam generator according to the present invention.
Figure 4:
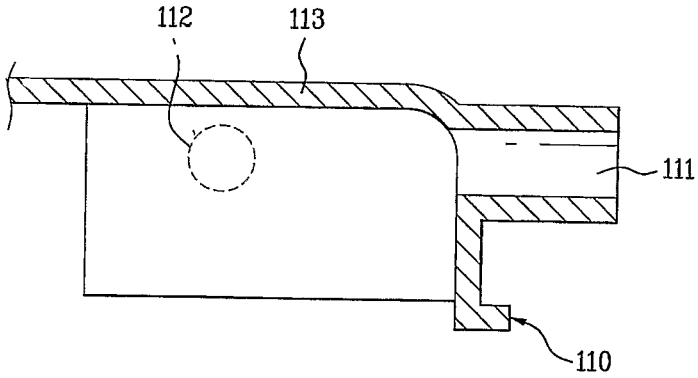
FIG. 4 is a diagram illustrating key parts according to an I-I line of FIG. 3.

FIG. 3 is a perspective view illustrating an embodiment of a steam generator according to the present invention. FIG. 4 is a diagram illustrating key parts according to an I-I line of FIG. 3.

As shown in FIGS. 3 and 4, the steam generator according to the embodiment of the present invention includes a case for storing water for generating steam an inlet 111 provided in the case for drawing water there through, an outlet 112 provided in the case for discharging steam there through and a water-inlet-proof-partition-wall 800 for preventing the water within the case from being discharged through the outlet.

The case may be formed as one body and alternatively may be formed by plural parts fastened thereto.

Preferably, the case is formed by two parts for easy fastening.

The case may includes an upper case and a lower case, and the case provided with the upper case 110 and the lower case 120 is illustrated in FIGS. 3 and 4.

In that case, the upper case 110 includes the inlet 111 having a lower end thereof opened for drawing water there through and the outlet 112 for discharging steam there through. The lower case 120 is fastened to a lower portion of the upper case 110 and an upper end thereof may be opened.

Here, it is preferred that the inlet 111 is provided in an upper portion of the case, that is, the upper case 110 to prevent the water drawn into the case from flowing back.

Also it is preferred that the outlet 112 is provided in the upper portion of the case, that is, the upper case 110 to facilitate the separation of steam from the water within the case due to the characteristic of steam in which steam tends to rise upwardly.

Furthermore, a temperature sensor 400 for sensing the temperature of the water drawn into the steam generator and a water level sensor 300 for sensing a water level are provided in the steam generator.

Each sensing area of the temperature sensor 400 and the water level sensor 300 is installed within the steam generator, mainly fixedly secured through the upper case.

Moreover, the upper case 110 is connected to a water supply valve (not shown) and an auxiliary water supply pipe (not shown) of the laundry machine, such that water may be drawn into the steam generator. The outlet 112 is connected to a drum (not shown) and an auxiliary steam pipe (not shown) of the laundry machine, such that high temperature steam is supplied into the drum.

Preferably, a steam concentrating part 113 projected upwardly is formed so that, some upper surface of the outlet side in the upper case 110 may have higher inner space than the other portion of the upper surface.

That is so that the steam which is generated by the heater 200 and rises may be put together in an outlet side more smoothly and directly discharged through the outlet 112.

To prevent water from flowing back through the inlet 111, it is preferred that the inlet is provided higher than a water level where water may be stored within the case. Thus, it is also preferred that the inlet is provided in the steam concentrating part 113.

Preferably, the direction between the inlet 111 and the outlet 112 is perpendicular for facilitating drainage with the water supply pipe or the steam pipe regardless of the size of the steam concentrating part 113.

Also, that is to discharge steam through the outlet 112 more smoothly.

Thus, since the embodiment presents the inlet 111 and the outlet 112 are formed adjacent to each other, a water-inlet-proof-partition-wall 800 is further included to prevent water from being discharged through the outlet 112. However, this embodiment is not limited thereto.

The water-inlet-poof-partition-wall 800 is expanded in parallel with a direction of water inlet drawn through the inlet 111. At that time, preferably, an end of the water-inlet-proof-partition-wall 800 is expanded to the outlet 112.

The water-inlet-proof-partition-wall 800 is projected at a side of the inlet 111 from a wall having the inlet formed thereon, and formed in a plate shape having a vertical surface parallel with a wall having the outlet 112 formed thereon.

Alternatively, the water-inlet-proof-partition-wall 800 may be crossing over the steam concentrating part 113. In that case, steam may not be discharged smoothly, because, the water-inlet-proof-partition-wall 800 can shut off a moving path of steam.

Thus, it is preferred that the steam concentrating part 113 is formed to include a corner of the upper case 110 and the other corner thereof, not to include only one corner of the upper case 110.

Operation of the steam generator having the above configuration will be described.

First, to generate steam by using the steam generator, the water supply valve is on and water is supplied into the steam generator through the water supply pipe and the inlet 111.

At that time, since the water-inlet-proof-partition-wall 800 is provided in a first side of the inlet 111, the water supplied into the steam generator may be prevented from being drawn through the outlet 112 even with splash or spray caused by high water pressure.

Once the water supply is completed, the heater 200 mounted within the steam generator is operated to generate steam.

The generated steam is discharged through the outlet 112 of the steam generator and supplied to the laundry within the drum thereby enhancing washing efficiency or performing a refresh function.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

A steam generator according to the present invention has an industrial applicability that water supplied though an inlet may be prevented from being drawn through an outlet.

Furthermore, the steam generator according to the present invention has another industrial applicability that water splash may be prevented from being drawn through the outlet, even though water in the air causes splash due to a high pressure of the water supplied through the inlet.

Therefore, the steam generator according to the present invention has the industrial applicability of preventing problems which might arise in supplying water, not steam, to the laundry within the drum, because the steam generator according to the present invention can prevent water, not steam from being supplied in the drum.

The invention claimed is:

1. A steam generator comprising:

a case having predetermined space formed by fastening an upper case and a lower case for storing water for generating steam therein;

a steam concentrating part projected upwardly of the upper case;

an inlet provided in the steam concentrating part for drawing water there through;

an outlet provided in the steam concentrating part for discharging steam there through, wherein the outlet is formed adjacent to the inlet; and a water-inlet-proof-partition-wall provided between the inlet and the outlet for preventing the water drawn through the inlet from being discharged through the outlet, wherein the inlet and the outlet are arranged at a side wall of the steam concentrating part.

2. The steam generator of claim 1, wherein the water-inlet-proof-partition-wall is expanded in parallel with the inlet direction of the water drawn from the inlet.

3. The steam generator of claim 2, wherein the water-inlet-proof-partition-wall is formed in a plate shape expanded from a wall having the inlet formed thereon in parallel with a wall having the outlet formed thereon.

4. The steam generator of claim 3, wherein an end of the water-inlet-proof-partition-wall is expanded to a normal vector of the outlet.

5. The steam generator of claim 1, wherein the inlet direction of the water drawn through the inlet is perpendicular to an outlet direction of the steam discharged through the outlet.

6. The steam generator of claim 1, wherein the inlet and the outlet are arranged horizontally.

* * * * *